US005543593A

United States Patent [19]

Turek

[11] Patent Number: 5,543,593

[45] Date of Patent: Aug. 6, 1996

[54] ELECTRICAL SWITCH LOCKOUT DEVICE

[75] Inventor: Mark E. Turek, Wheaton, Ill.

[73] Assignee: Prinzing Enterprises, Inc., Warrenville, Ill.

[21] Appl. No.: 301,697

[22] Filed: Sep. 7, 1994

[51] Int. Cl.[6] ..... H01H 9/28

[52] U.S. Cl. ..... 200/43.11; 200/43.14

[58] Field of Search ..... 200/43.11, 43.13, 200/43.14, 43.15, 43.01, 43.22, 329, 330, 331, 332.2; 70/DIG. 30

[56] References Cited

U.S. PATENT DOCUMENTS

| | | | |
|---|---|---|---|
| 2,169,860 | 8/1939 | Von Hoorn | 200/43.22 |
| 2,265,438 | 12/1941 | Marple . | |
| 3,096,409 | 7/1963 | Hubbell et al. | 200/43.22 |
| 3,186,981 | 6/1965 | De Ronde . | |
| 4,669,281 | 6/1987 | Young | 70/163 |
| 4,733,029 | 3/1988 | Kobayashi et al. | 200/43.1 |
| 4,978,816 | 12/1990 | Castonguay et al. | 200/43.15 |
| 5,021,616 | 6/1991 | Hardt | 200/43.18 |
| 5,148,910 | 9/1992 | Williams | 200/43.19 |
| 5,260,528 | 11/1993 | Benda | 200/43.22 |
| 5,434,378 | 7/1995 | McLean | 200/43.22 |

*Primary Examiner*—David J. Walczak

*Attorney, Agent, or Firm*—McAndrews, Held & Malloy, Ltd.

[57] ABSTRACT

A lockout device for an electrical switch has a mounting plate adapted to be attached to the cover plate of the electrical switch. The mounting plate has a pair of mounting apertures which permit it to be attached to the face plate and an aperture formed to circumscribe the switch's actuation member. A blocking plate extends from the mounting plate near its bottom edge. A cover is slidably connected to the mounting plate for movement between an open position at which the actuation member is accessible and a closed position at which the open bottom of the cover abuts the blocking plate so that cover and blocking plate enclose the actuation member. A locking mechanism allows the cover to be locked in its closed position. The cover can be transparent so that the actuation member is visible through the cover when the cover is in its closed position.

23 Claims, 2 Drawing Sheets

Fig. 2
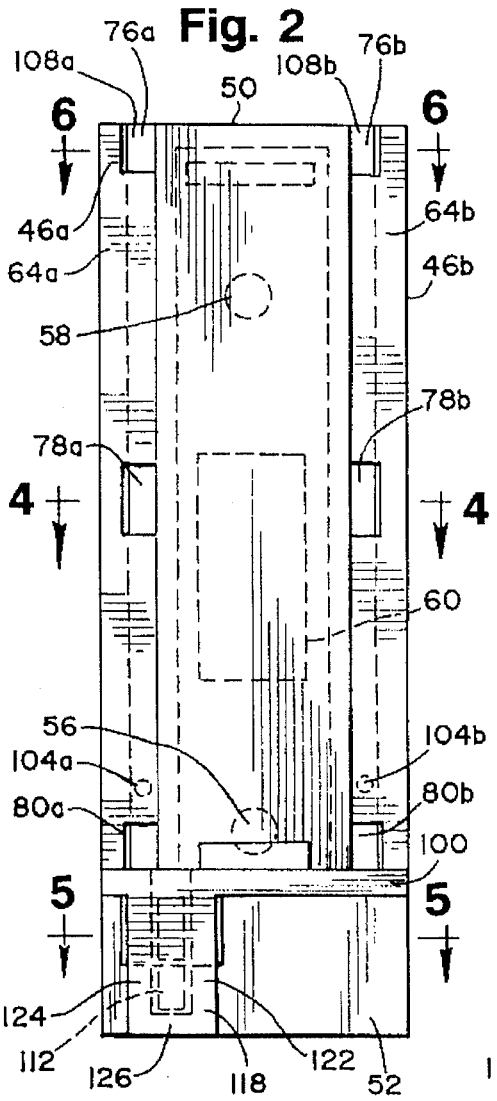
Fig. 3
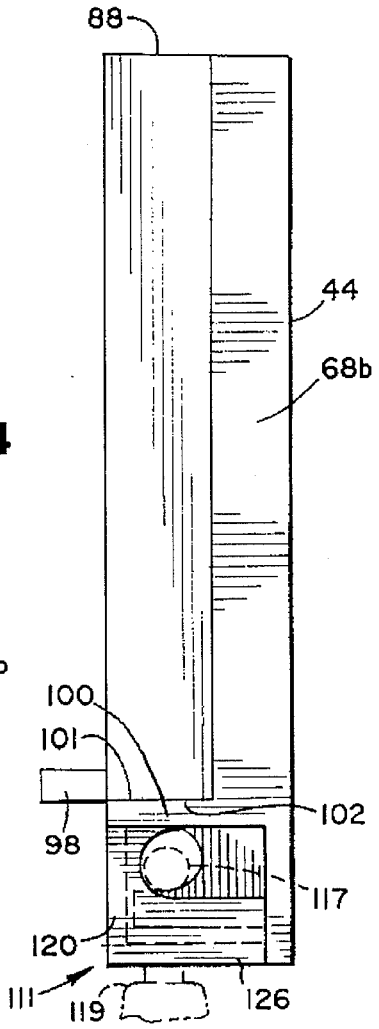
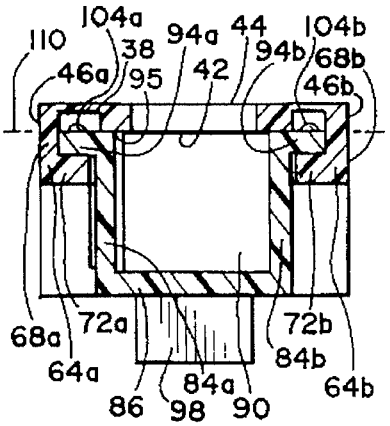
Fig. 4
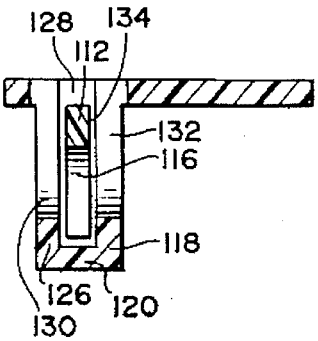
Fig. 5
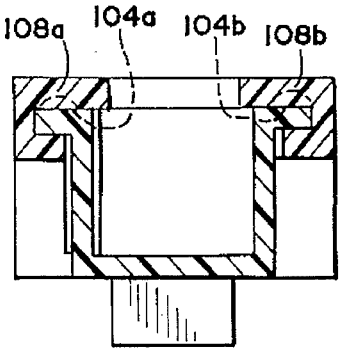
Fig. 6

ELECTRICAL SWITCH LOCKOUT DEVICE

FIELD OF THE INVENTION

The present invention relates generally to manually operated switches and, more particularly, to a lockout device for limiting access to manually operated switches.

BACKGROUND OF THE INVENTION

In many instances it is desirable to limit the unauthorized operation of manually actuated electrical switches. For example, small children often "play" with household light switches by turning them on and off. Although this is primarily an annoyance to the other occupants of the house, it can also be dangerous. Similarly, in public and quasi-public buildings such as train stations, schools, retail stores, and the like, the unauthorized use of light switches can be dangerous because of the large number of individuals moving through these building. Wall mounted switches are also used for controlling power to machinery. In such applications it is desirable to limit access to the switch both during normal operation and during repair.

Accordingly, it is an object of the present invention to provide a device for preventing unauthorized use of manually actuated electrical switches.

Another object of the present invention is to provide an electrical switch lockout device which is simple and economical to manufacture.

A further object of the present invention is to provide an electrical switch lockout device which can be attached to the face plate of a standard electrical switch without modifying the face plate.

Yet another object of the present invention is to provide an electrical switch lockout device for use with toggle-type switches in which the toggle lever can be completely enclosed to prevent its unauthorized actuation.

Other objects and advantages of the invention will become apparent upon reading the following detailed description and appended claims, and upon reference to the accompanying drawings.

SUMMARY OF THE INVENTION

The above and other objects are achieved by a lockout device comprising a mounting plate adapted to be attached to the face plate of the electrical switch. The mounting plate has an aperture formed to circumscribe the actuation member of the switch when the mounting plate is attached to the face plate. A blocking plate extends from the front face of the mounting plate. A cover has an open back and an open bottom and is slidably connected to the mounting plate such that its open back abuts the front face of the mounting plate. The cover is slidable between an open position at which the actuation member is accessible and a closed position at which the open bottom of the cover abuts the blocking plate so that cover and blocking plate enclose the actuation member. A locking mechanisms allows the cover to be locked in its closed position.

According to another aspect of the present invention, the cover is transparent so that the actuation member is visible when the cover is in its closed position.

According to yet another aspect of the present invention, the lockout device includes tracks formed in the edges of the mounting plate and flanges formed in the cover, adjacent the open back. The flanges slidably engage the tracks to permit the cover to slide with respect to the mounting plate.

According to another aspect of the present invention, the mounting plate includes apertures positioned to align with the mounting apertures in the face plate so that the lockout device can be connected to the face plate.

According to still another aspect of the present invention, the cover and mounting plate both include an aperture formed to receive the bolt of a external padlock. The apertures aligning with each other when the cover is in its closed position, so that a padlock can be used to lock the cover in its closed position.

BRIEF DESCRIPTION OF THE DRAWINGS

For a more complete understanding of this invention reference should now be had to the embodiment illustrated in greater detail in the accompanying drawings and described below by way of example of the invention.

In the drawings:

FIG. 2 is a front elevation view of the lockout device of FIG. 1;

FIG. 3 is a side elevation view of the lockout device of FIG. 1;

FIG. 4 is a sectional view of the lockout device along line 4—4 of FIG. 2;

FIG. 5 is a sectional view of the lockout device along line 5—5 of FIG. 2; and FIG. 6 is a sectional view of the lockout device along line 6—6 of FIG. 2.

DETAILED DESCRIPTION OF THE PREFERRED EMBODIMENT

Figure 1:
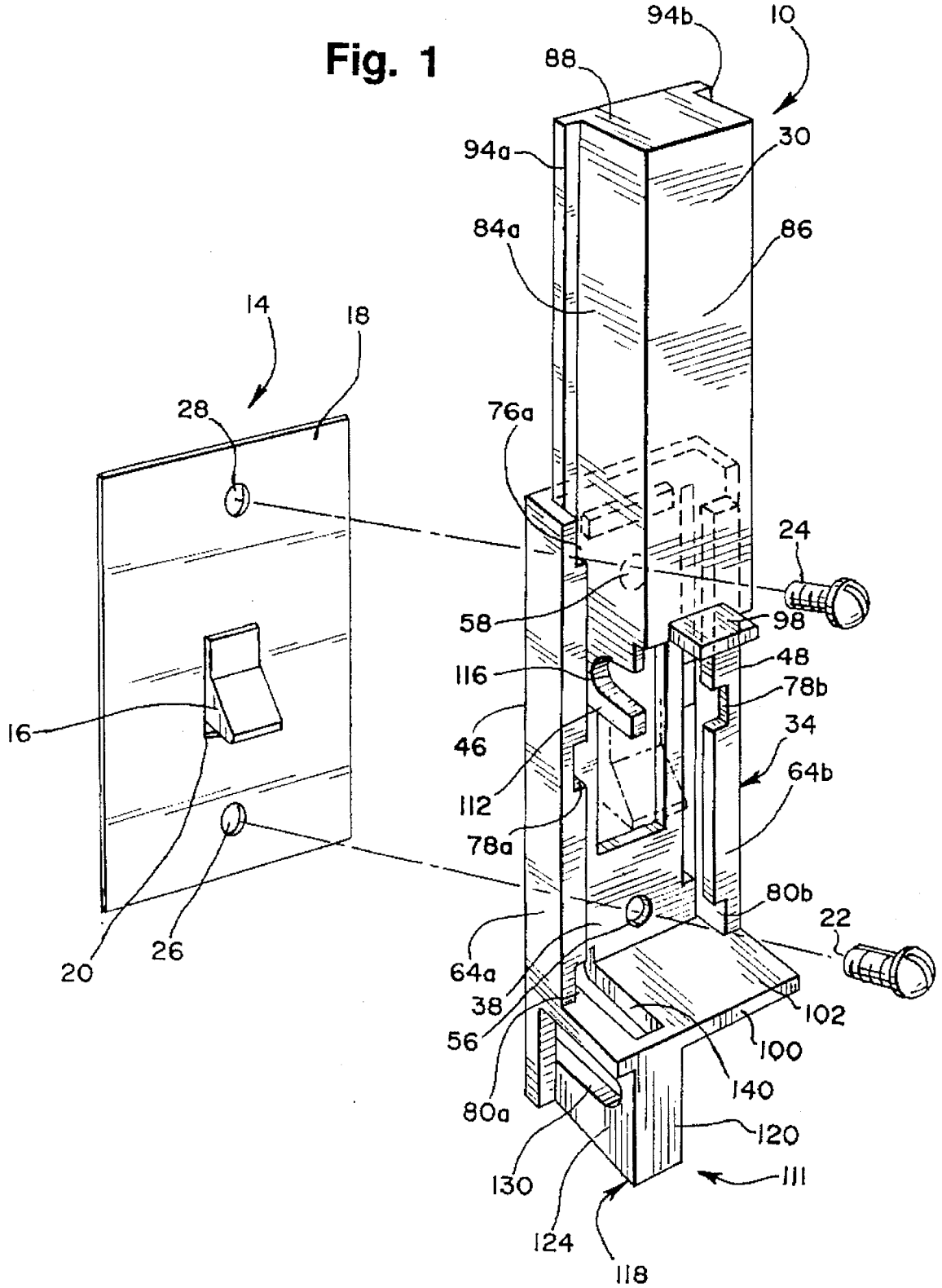
FIG. 1 is perspective view of an electrical switch lockout device in accordance with the present invention.

In the following detailed description, spatially orienting terms are used such as "left," "right," "vertical," "horizontal," and the like. It is to be understood that these terms are used for convenience of description of the preferred embodiments by reference to the drawings. These terms do not necessarily describe the absolute location in space, such as left, right, upward, downward, etc., that any pan must assume.

Referring now to the drawings, FIG. 1 illustrates a lockout device 10 in conjunction with a toggle-type electrical switch 14, such as a wall-mounted light switch. Although the switch 14 is shown as a toggle-type switch, it should be appreciated that the lockout device 10 can also be utilized with other switches such as push button or sliding switches. The electrical switch 14 includes a housing (not shown) which is mounted in the wall and contains the switching elements (not shown). An actuating member 16, such as a toggle lever, extends from the front of the housing, beyond the plane of the wall. A face plate 18 is mounted over the housing and has a central aperture 20 for receiving the actuating member 16. Securing screws 22,24 extend through mounting apertures 26,28 in the face plate 18 and thread into tapped holes (not shown) in the housing to secure face plate 18 in position.

Lockout device 10 utilizes a two-piece design consisting of a cover 30 movably connected to a base member 34. Base member 34 is constructed to be connected to the face plate 18 of the switch 14. Cover 30 is slidably connected to base member 34 for movement between an open position (see FIG. 1) at which actuating member 16 is accessible and a closed position (see FIGS. 2 and 3) at which cover 30 encloses actuating member 16 to prevent unauthorized access to the switch 14.

Cover 30 and base member 34 are both injection molded from polycarbonate; however, these items can readily be formed using other materials such as polyvinyl chloride (PVC) or ABS plastic. Preferably both pieces, and in particular the cover 30, are formed from a transparent material so that the actuating member 16 is visible when the cover 30 is in its closed position.

As can best be seen in FIGS. 2–5, base member 34 includes a generally rectangular mounting plate 38 having a front face 42, a back face 44, first and second opposing edges 46*a,b,* a top edge 50, and a bottom edge 52. A pair of mounting apertures 56,58 formed in mounting plate 38 align with the face plate mounting apertures 26,28 to permit mounting plate 38 to be connected to face plate 18. As will be appreciated, the number and positioning of the mounting apertures will vary in accordance with the switch employed.

To attach the lockout device to the wall switch 14, the securing screws 22,24 are removed from the cover plate 18. With the cover 30 moved to its open position, the mounting apertures 56,58 in the lockout device 10 are aligned with the cover plate mounting apertures 26,28 and the screws 22,24 are then inserted through the mounting apertures 56,26,58, 28 and threaded into the tapped holes in the switch box.

When lockout device 10 is connected to switch 14, the back face 44 of mounting plate 38 fits flushly against the front of face plate 18. An aperture 60 (see FIGS. 1 and 2) formed in mounting plate 38 is shaped and positioned to circumscribe actuating member 16 when mounting plate 38 is connected to face plate 18. As will be appreciated, the size, shape and position of aperture 60 will be dictated by the type of actuating member 16 employed by the switch 14.

First and second tracks 64*a,b* extend upwardly from the front face 42 of mounting plate 38, along the mounting plate first and second edges 46*a,b*, respectively. As can best be seen in FIG. 4, tracks 64*a,b* each include an upstanding side wall 68*a,b* and top wall 72*a,b* extending inwardly and perpendicularly from the top of a respective side wall 68*a,b*. As can best be seen in FIGS. 1 and 2, a plurality of notches or open portions 76*a*,76*b*,78*a*,78*b*,80*a*,80*b* are formed in each top wall 72*a,b*. The sections of the mounting plate 38 opposite the track top walls 72*a,b* are open (i.e., no material is present), whereas the portions opposite the notches 76-80 contain material. This arrangement reduces the complexity of the die used to mold base member 34, as would be appreciated by one skilled in the art of injection molding.

Cover 30 is generally box-shaped and includes first and second generally parallel side walls 84*a,b* (see FIG. 4), a front wall 86 (see FIG. 4) extending between the front edges of the side walls 84, and a top wall 88 (see FIG. 1) extending between the top edges of the side walls 84 and the front wall 86. Cover 30 also has an open back opposite front wall 86 and an open bottom opposite top wall 88. The walls of cover 30 define an inner compartment 90 (see FIG. 4) which is sized to contain actuating member 16 when cover 30 is in its closed position.

Integral flanges 94*a,b* extend outwardly from the back edges of the sidewall 84*a,b* (see FIG. 4). Flanges 94*a,b* are constructed to slidably engage tracks 64*a,b,* so as to slidably connect cover 30 to base member 34. When cover 30 is connected to base member 34, the back edge 95 of cover 30 fits flushly against the front face 42 of mounting plate 38 such that the open back of cover 30 abuts the mounting plate front face 42 (see FIGS. 1 and 4). There is a close, but free sliding fit between tracks 64*a,b* and flanges 94*a,b* for linear movement between open and closed positions. In particular, the top walls 72*a,b* of tracks 64*a,b* keep cover 30 in place against the mounting plate front face 42, and the side wails 68*a,b* limit the lateral movement of cover 30.

Cover 30 is slidable along a linear path between an open position at which actuating member 16 is accessible (see FIG. 1 ) and a closed position at which the cover 30 encloses actuating member 16 to prevent unauthorized activation of the switch 14 (see FIGS. 2 and 3). Preferably, lockout device 10 is mounted in the orientation illustrated in FIG. 1, so that gravity normally biases cover 30 to its closed position. A handle 98 is integrally formed with cover 30 to assist in moving cover 30 between its open and closed positions.

Stop means are provided for limiting travel of cover 30 between the open and closed positions. In particular, a blocking plate 100 serves as a first stop means for stopping cover 30 at its closed position. The blocking plate 100 is integrally formed with base member 34 and extends perpendicularly from the mounting plate front face 42, near its bottom edge 52. When cover 30 is in the closed position, the bottom surface 101 of cover 30 fits flushy against the top face 102 of blocking plate 100 such that blocking plate 100 seals the cover's open bottom and prevents access to actuating member 16 (see FIGS. 2 and 3).

A second stop means prevents cover 30 from traveling beyond its open position. The second stop means includes a pair of raised nipples 104*a,b* formed in cover 30 (see FIG. 4) and a pair of reciprocal stops 108*a,b* formed in mounting plate 38. Stops 108*a,b* are positioned to abut nipples 104*a,b* when cover 30 is moved to its open position (see FIG. 6). Preferably, nipples 104*a,b* are formed in the backs of flanges 94*a,b,* near the bottom edge of cover 30 (see FIG. 2). Reciprocal stops 108*a,b* are formed in tracks 64*a,b* near the top 50 of mounting plate 38 (see FIG. 2). As can be seen in FIG. 4, the material across from the center notches 78*a,b* is lower than the plane 110 of the mounting plate front face 42. As such, this portion of the mounting plate does not contact the nipples 104*a,b* when the cover 30 is slid along the tracks 64*a,b*. By contrast, the material across from the two top notches 76*a,b* is flush with the plane 110 of the mounting plate front face 42, so as to form the reciprocal stops 108*a,b* (see FIG. 6). As cover 30 is moved upwardly, flanges slide freely in the tracks 46*a,b* until the nipples 104*a,b* reach the reciprocal stops 108*a,b,* at which point the nipples 104*a,b* abut the stops 108*a,b,* preventing further movement of the cover under normal forces. Application of increased force permits the nipples 104*a,b* to be moved past the reciprocal stops 108*a,b,* so that the cover 50 can be connected to and removed from the base member 34 during assembly and installation.

A locking means 111 allows cover 30 to be locked in its closed position. Locking means 111 includes an extension piece 112 integrally formed in the bottom edge of one of the side walls 84 of cover 30. An aperture 116 formed in extension piece 112 is sized to receive the bolt 117 from an external padlock 119 (see FIG. 3). Preferably, the extension piece aperture 116 is hook-shaped (see FIGS. 1 and 3); however, the aperture 116 can be other shapes such as circular.

As can best be seen in FIGS. 1–3 and 5, an interlock 118 is integrally formed with mounting plate 38. Interlock 118 extends from the front face 42 of mounting plate 38, below blocking plate 100. Interlock 118 has a front wall 120, a pair of generally parallel side walls 122,124, and a bottom wall 126. The back 128 of interlock 118 is open to make it easier to integrally mold interlock with mounting plate 38 (see FIG. 5). A pair of apertures 130, 132 formed in the interlock side walls 122,124 are shaped to receive the bolt from an external padlock. Preferably apertures 130,132 are U-shaped as illustrated in FIG. 1; however, they could readily be other shapes, such as circular.

The, walls of interlock 118 define an inner compartment 134 (see FIG. 5) which is sized to receive extension piece 112 when cover 30 is at the closed position. A slot 140 (see FIG. 1) extends through blocking plate 100 to permit extension piece 112 to slide into the interlock inner compartment 134. When cover 30 is in its closed position, the apertures 130,132 in interlock 118 align with the extension piece aperture 116 to permit the padlock bolt 118 to be inserted through the apertures 118,130,132 to lock cover 30 in its closed position.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A lockout device for a wall switch of the type having an actuating member and cover plate, comprising:

a mounting plate adapted to be attached to the cover plate of the electrical switch, said mounting plate having a front face, a back face adapted to abut the cover plate, first and second opposing edges, and an aperture extending between the front and back faces and formed to circumscribe the actuation member when the mounting plate is attached to the cover plate;

a blocking plate extending from the front face of said mounting plate;

a cover having an open back and an open bottom, said cover being slidably connected to said mounting plate such that the open back of said cover is positioned adjacent the front face of said mounting plate, said cover being linearly slidable between an open position at which the open bottom is positioned on one side of said actuation member and therefore the actuation member is accessible and a closed position at which the open bottom is positioned on an opposite side of said actuation member and wherein the open bottom of said cover is closed by said blocking plate so that said cover and said blocking plate cooperate to enclose the actuation member and thereby prevents the actuation member from being actuated; and locking means for locking said cover in its closed position.

2. A lockout device as recited in claim 1, wherein said mounting plate comprises first and second flanges formed with said mounting plate front face and extending along a portion of said first and second edges, respectively; and wherein said cover comprises first and second flanges formed with said cover, adjacent said open back of said cover, said first and second flanges being adapted to slidably engage said first and second tracks, respectively to slidably connect said cover to said mounting plate.

3. A lockout device as recited in claim 2, wherein said cover is box-shaped and comprises:

i) first and second generally parallel side walls, each side wall having a front edge, a back edge, a top edge, and a bottom edge, said first and second flanges extending outwardly from said back edge;

ii) a front wall having top and bottom edges, said front wall extending between said front edges of said side walls;

iii) said open back being positioned opposite said front wall;

iv) a top wall extending between said top edges of said side walls and said front wall; and v) said open bottom being positioned opposite said top wall.

4. A lockout device as recited in claim 1, wherein said electrical switch is of the type in which the cover plate is connected to the switch by at least one threaded fastener; and wherein said mounting plate includes apertures for cooperating with said at least one threaded fastener to fasten said mounting plate to the cover plate.

5. A lockout device as recited in claim 1, wherein said locking means comprises:

an extension formed on said cover and including an aperture formed to receive the bolt of a external padlock; and an interlock positioned on said mounting plate and having an aperture formed to receive the bolt of an external padlock, said extension aperture and said interlock aperture aligning with each other when said cover is in its closed position and thereby adapted to receive a padlock to lock the cover in its closed position.

6. A lockout device as recited in claim 5, wherein said extension aperture is hook shaped.

7. A lockout device as recited in claim 1, wherein said cover is formed of a transparent material.

8. A lockout device as set forth in claim 1, wherein said blocking member is integrally formed with said mounting plate.

9. A lockout device as set forth in claim 1, further comprising an handle integrally formed with said cover for assisting in moving said cover between its open and closed positions.

10. A lockout device as set forth in claim 1, further comprising means for preventing said cover from being removed from said mounting plate.

11. A lockout device as set forth in claim 10, wherein said means for preventing said cover member from being removed from said mounting plate comprises:

raised nipples formed in said cover; and stops formed in said mounting plate and positioned to abut said nipples when said cover is moved to its open position.

12. A lockout device as set forth in claim 1, wherein said lockout is adapted to be mounted on the cover plate such that said cover is normally biased to its closed position by gravity.

13. A lockout device for a wall switch of the type having an actuating member and cover plate; comprising:

a base member adapted to be attached to the cover plate, said base member comprising:

i) an generally rectangular mounting plate having a front face, a back face adapted to abut the cover plate, first and second opposing edges, a top edge, a bottom edge and an aperture extending between said front and back faces and formed to circumscribe the actuating member;

ii) a blocking plate extending perpendicularly from the front face of said mounting plate, adjacent its bottom edge;

iii) first and second tracks formed in said mounting plate front face and extending along a portion of said first and second edges, respectively;

a box-shaped cover comprising:

i) frist and second generally parallel side walls, each side wall having a front edge, a back edge, a top edge, a bottom edge and a flange extending outwardly from said back edge;

ii) a front wall having top and bottom edges, said front wall extending between the front edges of said side walls;

iii) an open back opposite said front wall;

iv) a top wall extending between the top edges of said side walls and said front wall; and v) an open bottom;

said outwardly extending flanges slidably engaging mounting plate tracks to slidably connect said cover to said mounting plate for linear movement between an open position at which the actuation member is accessible and a closed position at which said cover and said blocking plate cooperate to enclose the actuation member and thereby prevents the actuation member from being actuated; and locking means for locking said cover in its closed position.

14. A lockout device as recited in claim 13, wherein said locking miens comprises:

an extension piece extending from the bottom edge of one of said cover side walls, said extension piece including an aperture formed to receive the bolt from an external padlock; and an interlock positioned on said mounting plate and having an aperture formed to receive the bolt from an external padlock, said extension piece aperture and said interlock aperture aligning with each other when said cover is in its closed position and thereby adapted to receive a padlock to lock said cover in its closed position.

15. A lockout device as recited in claim 14, wherein said extension piece aperture includes a hook shape.

16. A lockout device as recited in claim 14, wherein said electrical switch is of the type in which the face plate is connected to the switch by at least one threaded fastener; and wherein said mounting plate includes apertures for cooperating with said at least one threaded fastener to fasten said mounting plate to the face plate.

17. A lockout device as recited in claim 14, wherein said cover is formed of a transparent material.

18. A lockout device as set forth in claim 14, wherein said blocking member is integrally formed with said mounting plate.

19. A lockout device as set forth in claim 14, further comprising a handle integrally formed with said cover for assisting in moving the cover between its open and closed positions.

20. A lockout device as set forth in claim 14, further comprising means for preventing said cover from being removed from said mounting plate.

21. A lockout device as set forth in claim 20, wherein said means for preventing said cover from being removed from said mounting plate comprises:

raised nipples formed in said cover; and stops formed in said mounting plate and positioned to abut said nipples when said cover is moved to its open position.

22. A lockout device as set forth in claim 13, wherein said lockout is adapted to be mounted on said cover plate such that said cover plate is normally biased to its closed position by gravity.

23. A lockout device as recited in claim 1, wherein said mounting plate includes tracks and said cover includes flanges slidably received within said tracks, said flanges sliding along said tracks as said cover moves between said open and closed positions.

* * * * *